US009855676B2

(12) United States Patent
Stichel et al.

(10) Patent No.: US 9,855,676 B2
(45) Date of Patent: Jan. 2, 2018

(54) APPARATUS FOR THE PRODUCTION OF MOLDED CONCRETE PARTS

(71) Applicant: KOBRA Formen GmbH, Lengenfeld (DE)

(72) Inventors: Holger Stichel, Lengenfeld (DE); Juergen Braungardt, Blaustein (DE)

(73) Assignee: KOBRA Formen GmbH, Lengenfeld (DE)

( * ) Notice: Subject to any disclaimer, the term of this patent is extended or adjusted under 35 U.S.C. 154(b) by 140 days.

(21) Appl. No.: 15/070,205

(22) Filed: Mar. 15, 2016

(65) Prior Publication Data

US 2016/0271829 A1 Sep. 22, 2016

(30) Foreign Application Priority Data

Mar. 16, 2015 (DE) ..... 10 2015 103 828

(51) Int. Cl.

| | |
|---|---|
| ***B28B 3/06*** | (2006.01) |
| ***B28B 7/24*** | (2006.01) |
| ***B28B 7/00*** | (2006.01) |
| ***B30B 15/02*** | (2006.01) |
| *B28B 3/02* | (2006.01) |

(52) U.S. Cl.

CPC ..... *B28B 7/24* (2013.01); *B28B 3/06* (2013.01); *B28B 7/0097* (2013.01); *B30B 15/026* (2013.01); *B28B 3/021* (2013.01)

(58) Field of Classification Search

CPC ..... B28B 3/021; B28B 3/06; B28B 7/0097; B28B 7/24; B30B 15/026

See application file for complete search history.

(56) References Cited

U.S. PATENT DOCUMENTS

| | | | | |
|---|---|---|---|---|
| 2,479,350 | A | 8/1949 | Haggart, Jr. | |
| 4,941,813 | A | 7/1990 | Grubb, Jr. et al. | |
| 7,291,306 | B2 * | 11/2007 | Ishler | B28B 3/021 264/334 |
| 7,575,700 | B2 | 8/2009 | Ishler | |
| 7,704,435 | B2 * | 4/2010 | Ishler | B28B 3/021 264/334 |

FOREIGN PATENT DOCUMENTS

| | | | |
|---|---|---|---|
| DE | 36 38 207 | A1 | 5/1988 |
| DE | 199 24 926 | A1 | 4/2000 |
| DE | 103 02 693 | B3 | 6/2004 |
| DE | 10 2004 004 188 | A1 | 10/2005 |
| DE | 10 2005 048 930 | A1 | 5/2006 |

* cited by examiner

*Primary Examiner* — James P Mackey

(74) *Attorney, Agent, or Firm* — Collard & Roe, P.C.

(57) ABSTRACT

An apparatus for the production of concrete molded parts in a molding machine includes an upper mold part having a pressure plate arrangement having multiple pressure plates, each facing an opening of a mold insert, wherein each of the pressure plates is screwed onto an intermediate plate, wherein the intermediate plate is connected with a punch plate on the upper mold part on the side facing the upper mold part, by way of at least one pressure punch. The intermediate plate is braced against the punch plate, in that at least one bolt that can be screwed on is passed through an accommodation on the intermediate plate, which bolt releasably engages into the punch plate and has a hollow body that encloses the bolt, between the intermediate plate and the punch plate.

14 Claims, 6 Drawing Sheets

APPARATUS FOR THE PRODUCTION OF MOLDED CONCRETE PARTS

CROSS REFERENCE TO RELATED APPLICATIONS

Applicant claims priority under 35 U.S.C. §119 of German Application No. 10 2015 103 828.5 filed Mar. 16, 2015, the disclosure of which is incorporated by reference.

BACKGROUND OF THE INVENTION

1. Field of the Invention

The invention relates to an apparatus for the production of molded concrete parts.

2. Description of the Related Art

Apparatuses for the production of molded concrete parts, such as paving bricks, for example, are typically used for machine production and contain a molding machine having a punch unit and a lower mold part configured as a mold, into which the punch unit can engage. Usually, one mold insert is or a number of mold inserts are configured in the lower mold part, whose cavities are open toward the top and the bottom. The lower mold part is set onto a horizontal bed with a lower delimitation plane of a brick field, which bed closes off the lower openings of the mold. The mold inserts are filled with concrete mixture through the upper openings; this mixture is subsequently pressed by way of pressure plates disposed on the punch unit, in that the pressure plates are lowered into the mold inserts through the upper openings. Subsequently, solidification of the concrete mixture to form shape-stable molded concrete parts takes place by means of shaking, typically of the bed. The parts are unmolded through the lower openings of the mold inserts.

The punch unit is connected with a vertical movement unit of the molding machine, which unit is typically hydraulically activated, and can be displaced vertically by means of this unit. The connection can be made, in a conventional design, by way of a top-load unit, which, together with the punch unit, usually forms an upper mold part as a module that can be handled as one part. A uniform brick height is achieved even with different compaction of the concrete mixture, by means of a stop on the punches of the punch unit.

In the design of such apparatuses for the production of molded concrete parts, attachment of the punch unit to the upper mold part and to the pressure plates has particular significance, because this attachment must allow positioning of the punches and stable support of the punches against forces that act in tilting and/or twisting manner.

From the general state of the art, apparatuses are known in which a punch is connected, by means of a welded connection, with a screw-on plate onto which a pressure plate is screwed, for easier replacement.

Thus, the production of compacted molded concrete bricks is described, for example in DE 10302693 B3. This production typically takes place in molding machines, in which a mold that lies on a shaker bed and has one or more mold inserts is filled with concrete mass. Pressure plates are introduced into the mold inserts from above; these plates are attached by vertical punches at lower ends. At their upper ends, the punches are welded to a punch carrier, usually a stable plate. The punch carrier is pressed downward during the shaping process, by way of a machine connection.

SUMMARY OF THE INVENTION

It is therefore the task of the invention to create an apparatus for the production of molded concrete parts, which has pressure punches that can be produced in simple and advantageous manner, and furthermore can also be replaced without material-processing interventions.

This task is accomplished by an apparatus according to the invention. Further advantageous embodiments of the invention are discussed below. These embodiments can be combined with one another in technically practical manner. The description, particularly in connection with the drawing, additionally characterizes and specifies the invention.

According to the invention, an apparatus for the production of concrete molded parts in a molding machine is created, which apparatus comprises an upper mold part having a pressure plate arrangement having multiple pressure plates, each facing an opening of a mold insert, wherein each of the pressure plates is screwed onto an intermediate plate, wherein the intermediate plate is connected with a punch plate on the upper mold part on the side facing the upper mold part, by way of at least one pressure punch. The intermediate plate is braced against the punch plate, in that at least one bolt is passed through an accommodation on the intermediate plate, which releasably engages into the punch plate, wherein the pressure punch comprises a hollow body that encloses the bolt between the intermediate plate and the punch plate.

Thus, the fundamental idea of the invention consists in structuring the pressure punch as a hollow body, in the interior of which a bolt is passed. On the one hand, the bolt is releasably connected with the intermediate plate, for example by way of a screw connection. On the other hand, the bolt is passed through an accommodation in the intermediate plate, so that a mechanical connection exists between the intermediate plate and the punch plate, producing bracing, wherein the hollow body is provided for transfer of force between the punch plate and the intermediate plate. Accordingly, the welding of pressure punches that has prevailed in the state of the art until now is avoided, so that a releasable attachment between the individual components of a molding machine is created. This makes cost-advantageous production of molding machines possible, and furthermore allows the servicing of wear parts or the retrofitting required as the result of retooling to different brick molds in simple manner, by means of replacement of the corresponding components.

According to an embodiment of the invention, the accommodation is formed as a depression, which has a step-shaped cross-section along a direction perpendicular to the surface of the intermediate plate.

The step-shaped cross-section can particularly be provided for the purpose of creating an attachment possibility for the bolt, so that the bolt can support itself against the intermediate plate in the axial direction, from the side of the pressure plate. This arrangement makes it possible to provide a corresponding counter-element on the opposite side, in the region of the punch plate, so that the bracing between the intermediate plate and the punch plate is achieved, wherein the distance between the two plates is established by means of the hollow body.

According to a further embodiment of the invention, the step-shaped cross-section on the side of the intermediate plate facing the punch plate has a first inside dimension that corresponds to an outside dimension of the bolt.

In order to be able to pass the bolt through the intermediate plate, it is accordingly provided to select the step-shaped cross-section of the accommodation in such a manner that the bolt can be passed through the intermediate plate.

According to a further embodiment, the step-shaped cross-section has a second inside dimension on the side of the intermediate plate that faces the pressure plate, which dimension is selected to be greater than the first inside dimension.

The step-shaped cross-section now continues in the direction of the pressure plate, in such a manner that widening of the cross-section takes place, which widening is characterized by a second inside dimension.

According to a further embodiment, a screw head affixed to the bolt can be introduced in the region of the second inside dimension in the intermediate plate, which head is disposed on the side that faces the pressure plate, below the surface of the intermediate plate.

The step-shaped cross-section is therefore suitable for accommodating a screw head affixed to the end of the bolt. This head can be structured, for example, as a hexagonal screw head, slotted screw head, or the like, so that the pressure plate that lies above it covers it completely and lies on the surface of the intermediate plate. The use of a screw head on the end of the bolt represents a simple possibility for producing the desired bracing between the intermediate plate and the punch plate.

According to a further embodiment, a nut that engages into an outside thread of the bolt can be introduced in the region of the second inside dimension in the intermediate plate, which nut is disposed on the side that faces the pressure plate, below the surface of the intermediate plate.

In contrast to the previous exemplary embodiment, here the bolt is not provided with a screw head, but rather can be made available as a threaded rod, for example, with which a nut is brought into engagement in the region of the second inside dimension. Bracing between punch plate and intermediate plate is possible according to this method of procedure, as well.

According to a further embodiment, the hollow body is configured as a hollow cylinder, the upper edge and lower edge of which are aligned plane-parallel to one another in the axial direction.

In order to allow the most uniform and tension-free transfer of force possible from the top-load unit to the pressure plates, it is advantageous that the side surfaces of the hollow cylinder are aligned plane-parallel to one another, wherein it can also be provided within the scope of the invention to align the side surfaces parallel to one another merely in certain sections at the upper edge or the lower edge, so that individual projections are formed, for example, the gaps between which do not necessarily have to be configured parallel.

According to a further embodiment, the bolt is configured with a circular cross-section.

The simplest structure possible of the apparatus is achieved in that the bolt is made available with a circular cross-section. Within the scope of the invention, however, it is also possible to equip the bolt, at least in certain sections, with individual segments that deviate from a circular cross-section, which segments can be used, for example, as a guide in the hollow body.

According to a further embodiment of the invention, the bolt is provided with an outside thread in the region of its end that faces the punch plate.

This method of procedure is particularly advantageous if the bolt is structured with a screw head on the intermediate plate. Accordingly, a nut can be attached on the side of the punch plate, on the outside thread, so that the intermediate plate is attached to the punch plate, supporting itself by way of the hollow body, by means of a screw connection. As has already been mentioned, however, it is also possible to provide a nut on the side of the intermediate plate, and to introduce the screw head from the side of the punch plate, for example, as long as the top-load unit allows sufficient space for a screw to be passed through in this region.

According to a further embodiment of the invention, each intermediate plate is provided with a plurality of bolts and hollow bodies.

This method of procedure makes stable attachment of the intermediate plate to the punch plate possible, wherein the number of bolts and intermediate bodies is selected accordingly, depending on the mechanical stress to be expected. Thus, for example, the intermediate plate can be structured with an essentially rectangular base surface, wherein two or more bolts and hollow bodies are disposed on the two longer sides, in each instance.

According to a further embodiment of the invention, the intermediate plate comprises openings by way of which an attachment element can be passed through, in order to make a screw connection with the pressure plate.

In order to attach the pressure plate to the intermediate plate, an attachment element is passed through corresponding openings according to this method of procedure, in order to be able to make a screw connection. In this regard, the attachment element can be structured as a threaded rod with a related nut, for example.

According to a further embodiment of the invention, the intermediate plate is formed in one piece.

It is advantageous if the intermediate plate is produced from one piece, together with the openings or the accommodations for the bolts, so that for one thing, production costs can be reduced, but for another, a stable structure is also achieved.

According to a further embodiment of the invention, the outside circumference of the intermediate plate forms a closed curve, together with the inner surfaces of the accommodations and the openings.

Accordingly, it is provided that the accommodations or the openings in the intermediate plate are not configured as isolated holes, but rather can be run along the outside circumference, along a single, closed curve. This arrangement makes it possible to produce the intermediate plate according to the invention in a single processing step, for example by means of a laser cutting method, from a plate-shaped base body. After completion of the formation of the outside contour of the intermediate plate, subsequently only finishing has to be undertaken to form the step-shaped cross-section, wherein this machining step does not, however, make any great demands regarding the production tolerances that must be met, because the distance between the intermediate plate and the punch plate is determined by the hollow bodies, and in the region of the second inside dimensions, only space for a screw head or a nut has to be created.

According to a further embodiment of the invention, the accommodations and the openings in the intermediate plate are offset toward the inside from the outer edge of the intermediate plate, wherein the accommodations and the openings have recesses that face in the direction of the outer edge.

The accommodations or openings provided in the form of boreholes can be formed directly on the outer edge of the intermediate plate, for one thing, wherein it is also provided, using the laser cutting method just described, to configure the corresponding holes for the accommodations and openings farther away from the outer edge of the intermediate plate, in that corresponding recesses are formed from the outer edge to the openings or accommodations. This arrangement makes it possible to increase the size of the cross-sectional surface of the hollow bodies, so that the pressure punch formed by way of the hollow bodies and bolts demonstrates great stability.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings,

FIG. 8 is a perspective side view of the pressure punch from FIG. 5 with a pressure plate screwed on.

DETAILED DESCRIPTION OF PREFERRED EMBODIMENTS

In the figures, components that are similar or functionally the same are provided with the same reference symbols.

Figure 1:
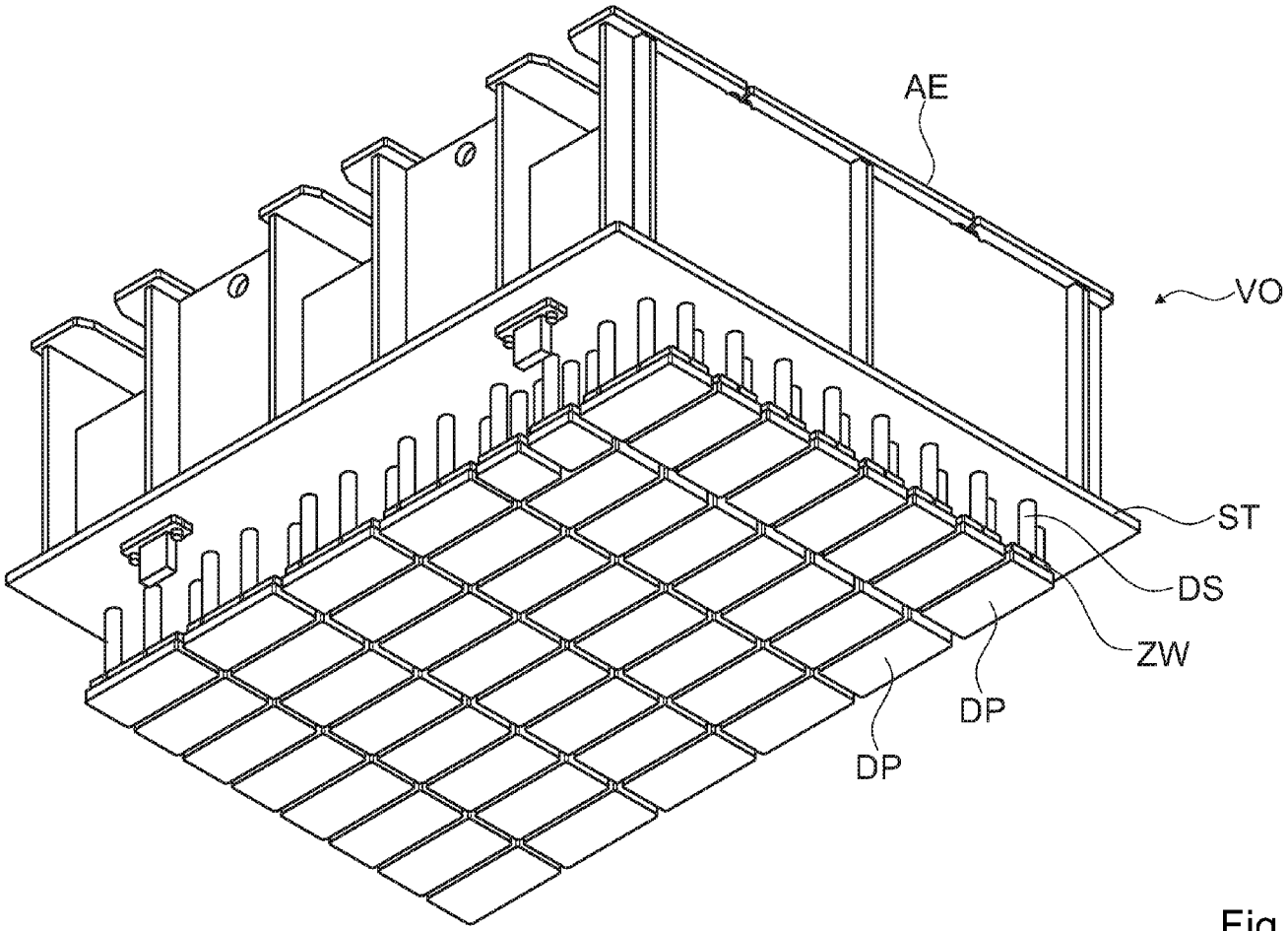
FIG. 1 is a perspective side view of an apparatus for the production of molded concrete parts according to an embodiment of the invention.

In FIG. 1, an apparatus VO is shown, which is suitable for the production of molded concrete parts in a molding machine. The apparatus VO has a mold disposed in replaceable manner. The mold is formed by a lower mold part and an upper mold part FB, not shown in FIG. 1. The lower mold part has a mold insert, in a manner usual in technology, which insert has a correspondingly selected number of openings, so that molded concrete parts can be produced in the desired number or size, using the apparatus VO. The upper mold part FB has a plurality of pressure plates DP, wherein each pressure plate DP corresponds with one of the openings. The pressure plates DP are connected with a punch plate ST by way of a plurality of pressure punches DS, in each instance.

Above the punch plate ST, a top-load device AE is provided, which can compress a concrete mixture introduced into the openings of the mold insert as a fill material, by way of the pressure punches DS. An intermediate plate ZW is disposed between the pressure plate DP and the pressure punches DS, on which intermediate plate the pressure plates DP are releasably attached, so that if necessary, the corresponding pressure plate can easily be replaced.

Figure 2:
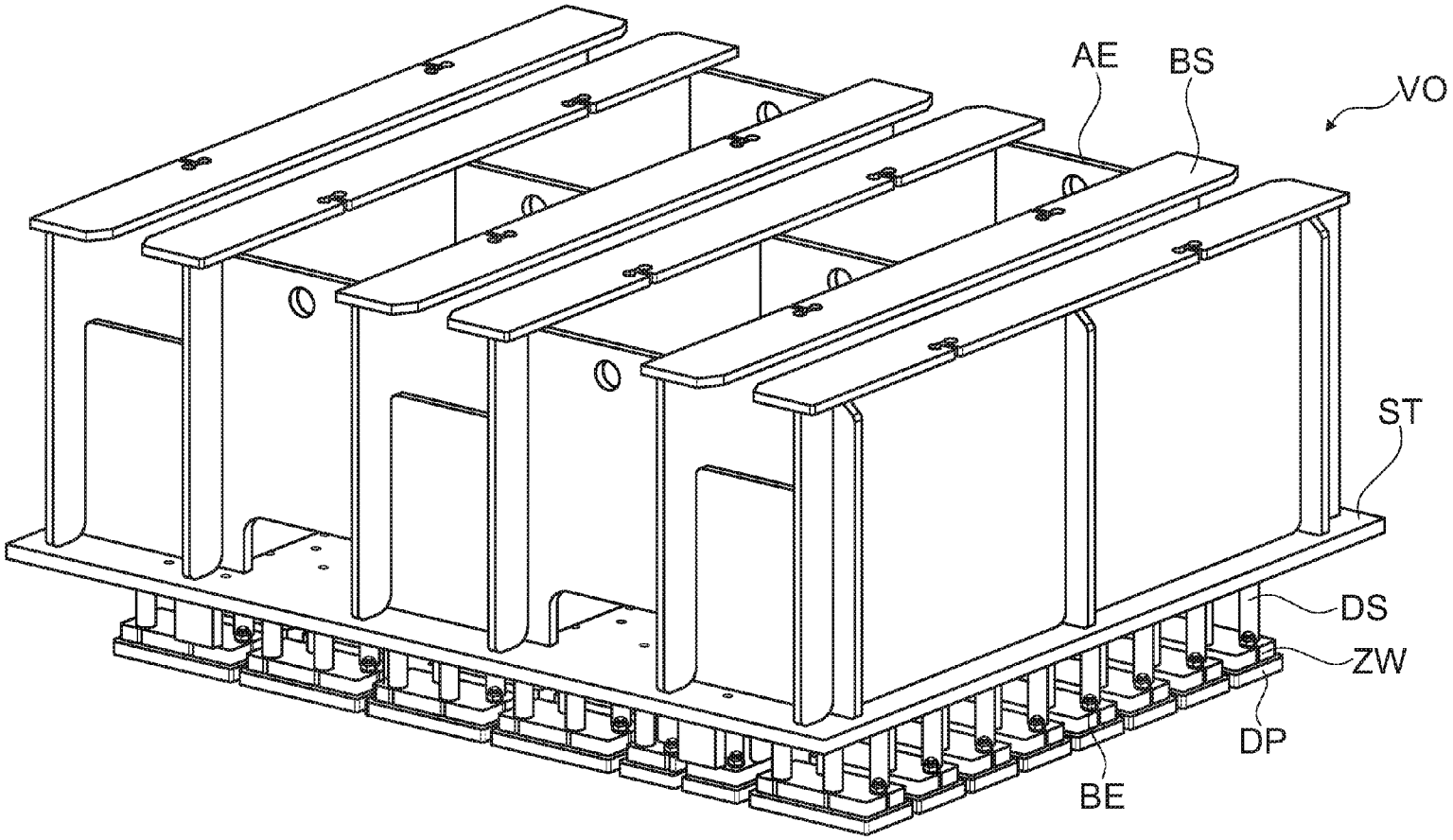
FIG. 2 is a further perspective side view of the apparatus from FIG. 1.

In FIG. 2, the apparatus VO is shown once again in a further perspective side view, from a different viewing angle, wherein now, the apparatus is no longer shown as in FIG. 1, from the underside, with the pressure plates DP disposed there, but rather the view is at a slant from above, onto the intermediate plates ZW. Attachment elements BE are provided for attachment of the pressure plates DP to the intermediate plates ZW. These elements are releasably screwed on, for example by a nut and a threaded rod, which is passed through the intermediate plate ZW and is connected with the pressure plate DP at its other end. As will still be explained below, multiple attachment elements BE can be provided for an individual pressure plate DP in this regard. On its top, the top-load element AE has attachment rails BS, which, together with further elements, which are not, however, an object of the present invention, allow accommodation of the top-load elements in a molding machine.

The pressure punches DS are disposed between the punch plate ST and the intermediate plate ZW; their structure will be explained in greater detail below, making reference to FIG. 3.

Figure 3:
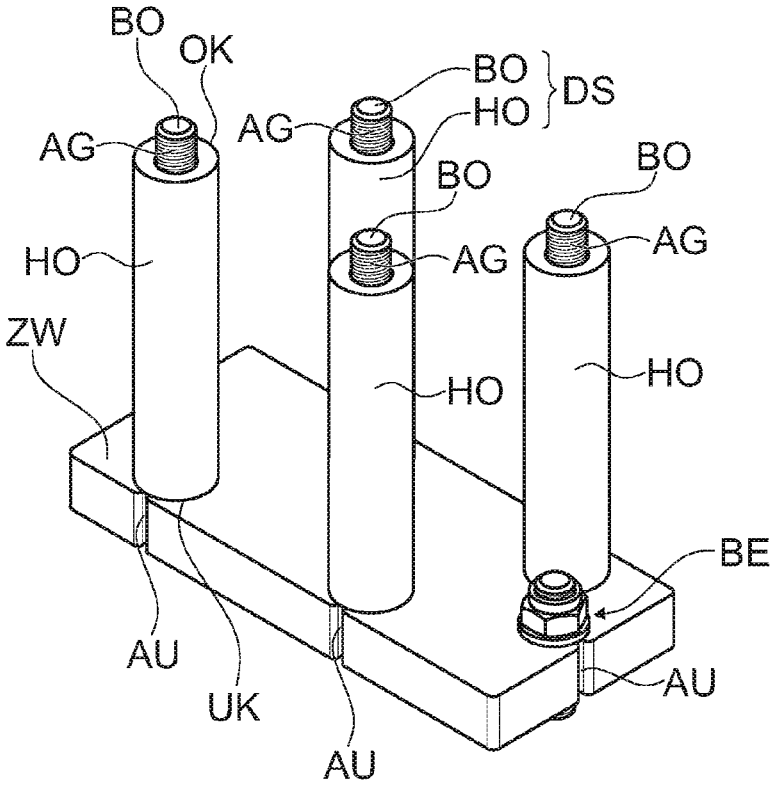
FIG. 3 is a perspective side view of parts of the apparatus from FIG. 1.

In FIG. 3, the attachment of the pressure punches DS on the intermediate plate ZW is shown in a perspective side view. In the exemplary embodiment shown, the intermediate plate ZW is provided with four pressure punches DS. Each pressure punch DS is structured from a bolt BO and a hollow body HO that surrounds the bolt BO. In the example shown, the hollow bodies HO are structured as hollow cylinders, the inside diameter of which is adapted to the circular cross-section of the bolt BO, in such a manner that the hollow bodies HO can be passed over the bolts BO.

In the axial direction, between its upper edge OK and its lower edge UK, the hollow body HO is structured with a length that is selected to be shorter than that of the bolt BO. Accordingly, it is possible that the bolt projects beyond both the upper edge OK and also the lower edge UK, so that an outside thread AG affixed there can be utilized for a screw connection with the punch plate ST or the intermediate plate ZW, respectively.

Accordingly, in the embodiment of FIG. 3 the pressure punches DS are formed by the hollow bodies HO, which, together with the bolts BO, create an attachment both in the direction of the upper mold part FB and downward in the direction of the pressure plates DP.

In order to be able to transfer the pressure forces to the pressure plates DP as uniformly as possible during lowering of the upper mold part FB, it is particularly provided that the side surfaces of the hollow bodies HO are structured to be plane-parallel to one another in the region of the upper edge OK and the lower edge UK, so that a force that acts perpendicularly, introduced from above by way of the top-load unit AE, is transferred to the pressure plates DP without stress.

Figure 4:
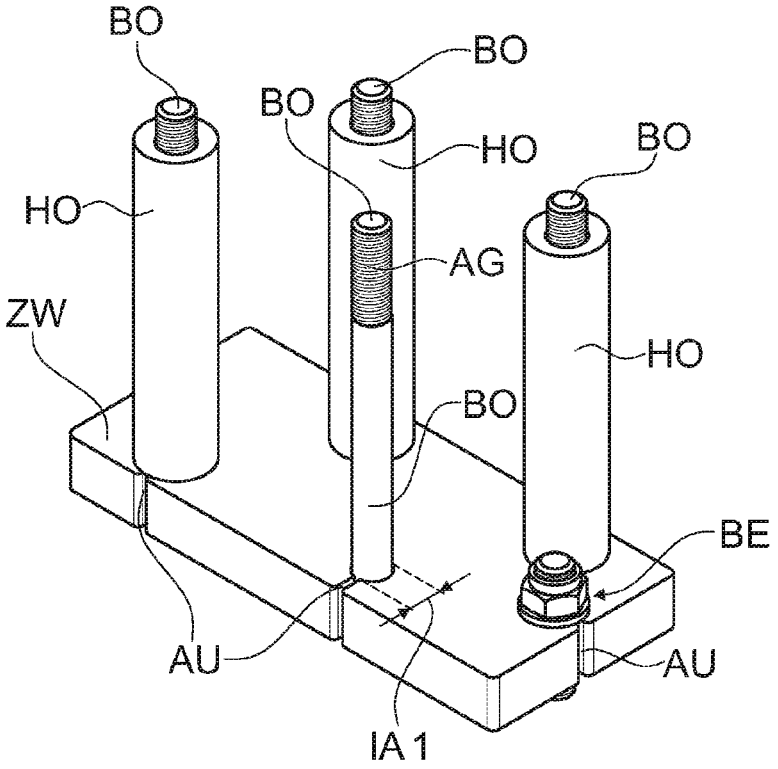
FIG. 4 is a further perspective side view of parts of the apparatus from FIG. 1.

In FIG. 4, the embodiment shown in FIG. 3 is shown once again, wherein the hollow body HO has been removed for a better explanation. It can be seen that the outside thread AG does not necessarily have to be passed over the entire outside on the bolt BO. Furthermore, it can be seen from FIG. 4 that the intermediate plate ZW has an accommodation AN (see FIG. 6) on the side facing the pressure punches DS, which accommodation is configured with a first inside dimension IA1, which is adapted to the outside dimension of the bolt BO, so that the bolt BO can be introduced into the intermediate plate ZW through the accommodation AN. As will be explained below, support of the bolt BO in the accommodation AN can take place from the side facing the pressure plate DP.

Figure 5:
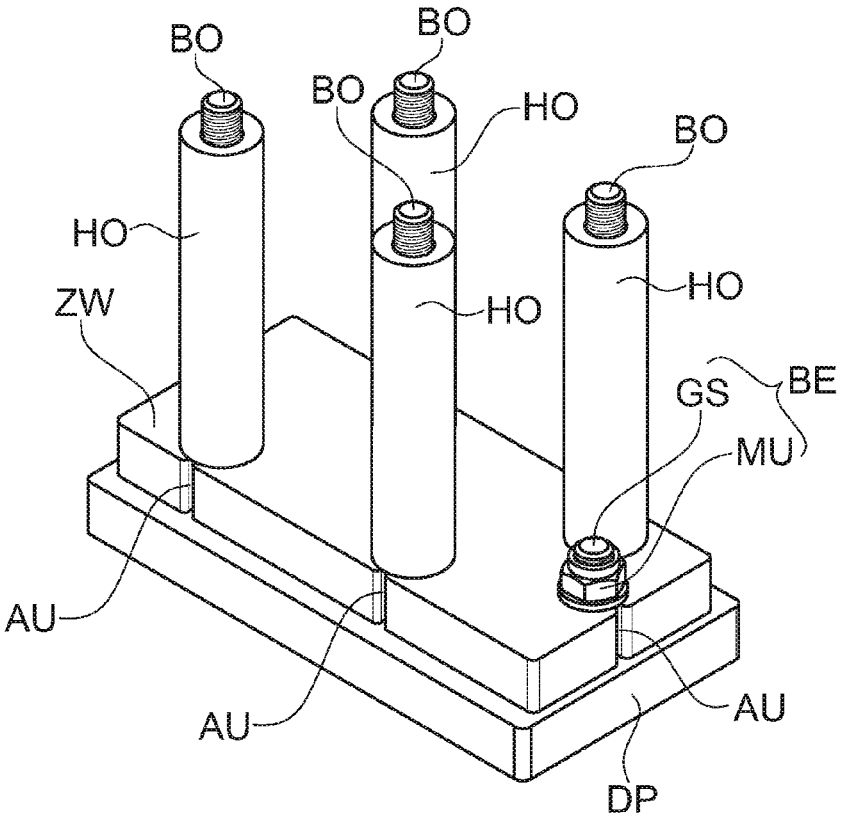
FIG. 5 is a further perspective side view of parts of the apparatus from FIG. 1.

In FIG. 5, the apparatus according to the invention is shown, in which the pressure plate DP is connected with the intermediate plate ZW by way of the attachment element BE. The parts of the outside thread AG of a bolt BO that project in the region of the upper edge OK can engage into corresponding attachments on the punch plate ST, so that bracing of the intermediate plate ZW relative to the punch plate ST can be carried out by way of the bolts BO. The distance between the punch plate ST and the intermediate plate ZW and consequently also relative to the pressure plate DP can be established by way of the hollow bodies HO, so that the apparatus according to the invention can be retrofitted without greater effort both in the event of wear and in the case of retrofitting of a molding machine. Furthermore, it is evident from FIG. 5 that the attachment of the pressure plate DP takes place by way of the attachment element BE, which is formed by a threaded rod GS and a nut MU in the example shown.

Figure 6:
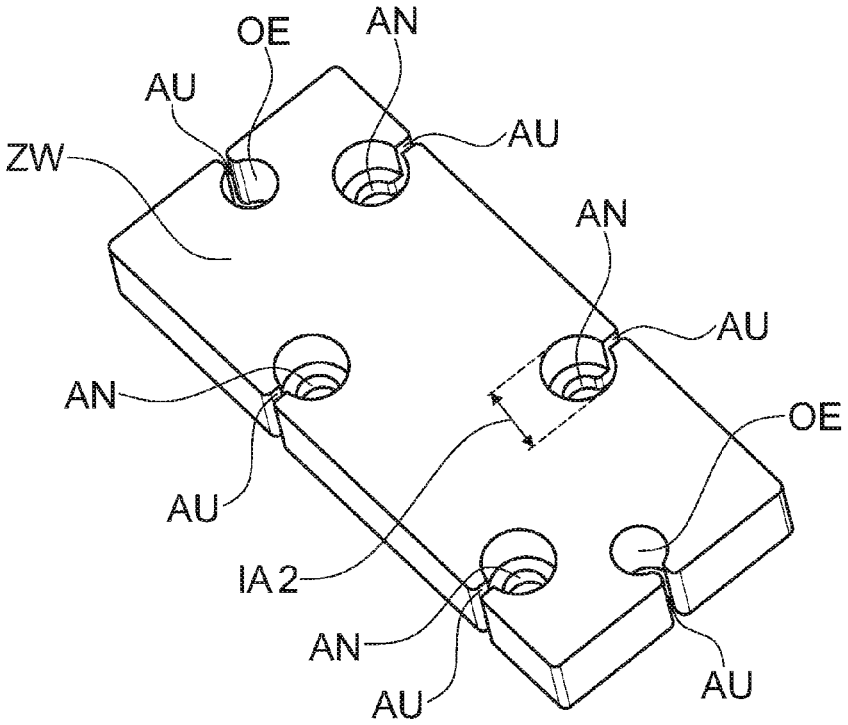
FIG. 6 is a further perspective side view of parts of the apparatus from FIG. 1.

In FIG. 6, a view of the intermediate plate ZW is shown from the side facing the pressure plate DP. It can be seen that not only the accommodations AN provided for attachment of the intermediate plate ZW with the bolts BO but also the opening OE, which serves for passing the threaded rod GS through, are provided with recesses AU, in each instance. Accordingly, the intermediate plate ZW is formed with an outside circumference, which, together with the inner surfaces of the accommodations AN and the openings OE, forms a closed curve. Thereby it is possible to produce the intermediate plate ZW shown in FIG. 6 from a planar block, using a single cutting line.

A correspondingly pre-machined metal body, in particular, can be used for this purpose. This body has corresponding plane-parallel main surfaces and is provided with the corresponding accommodations AN or the openings OE in a single work step, using a laser cutting method. In a finishing step, the step-shaped cross-section of the accommodation AN is subsequently formed in the intermediate plate ZW, so that a second inside dimension IA2 occurs on the side of the intermediate plate ZW that faces the pressure plate DP, which dimension is selected to be greater than the first inside dimension IA1. Thereby a screw head or a nut can be introduced in the region of this step-shaped depression, with which the bolt BO is screwed together on its outside thread AG, in order to brace the intermediate plate ZW against the hollow bodies HO.

Figure 7:
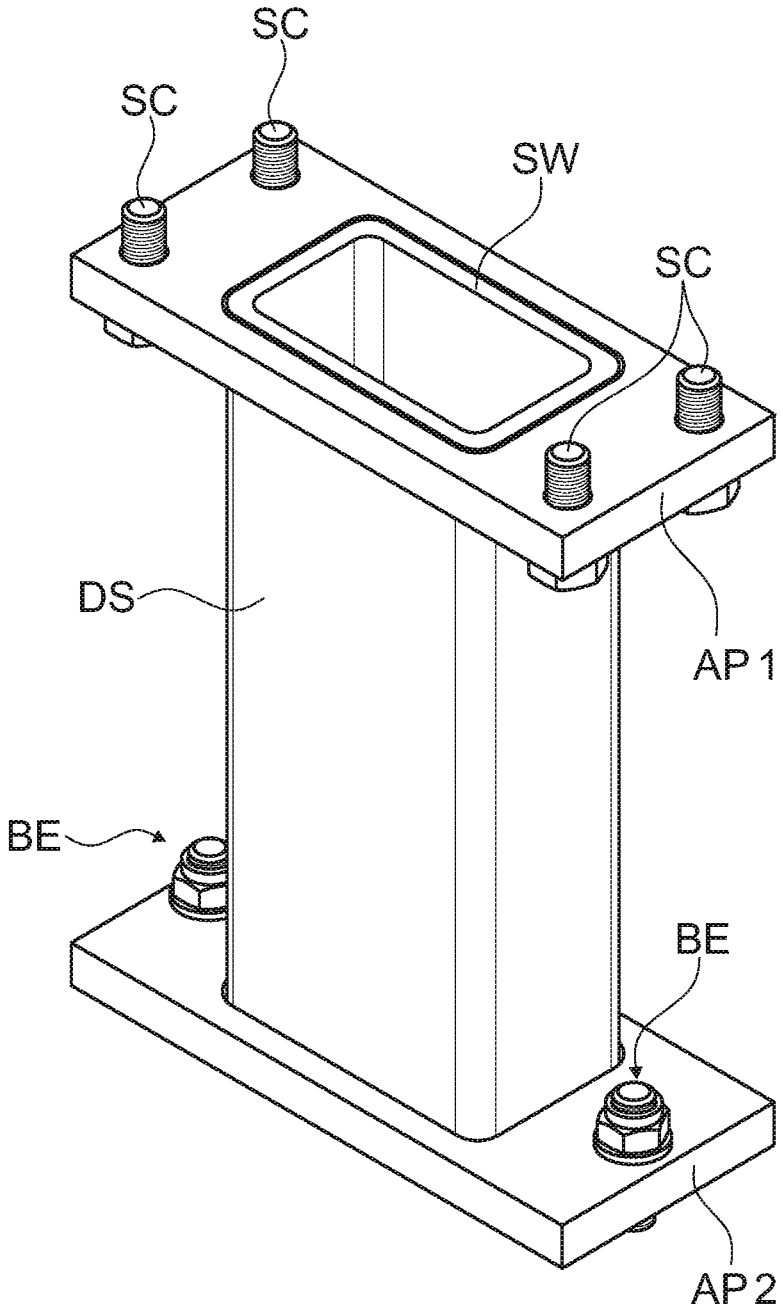
FIG. 7 is a perspective side view of a pressure punch for use in an apparatus for the production of molded concrete parts according to the state of the art.
Figure 8:
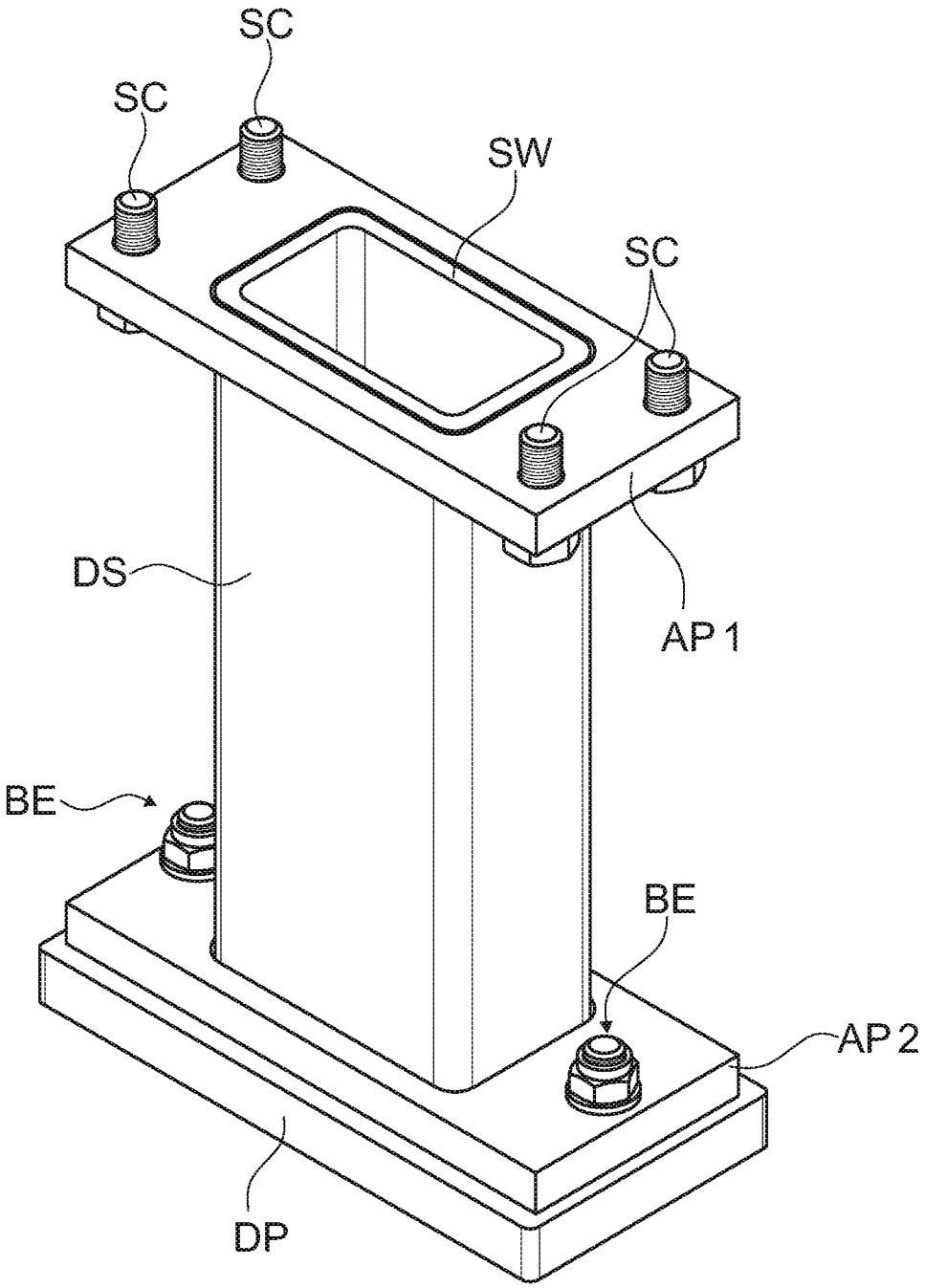

In comparison with this arrangement, a pressure punch according to the state of the art is shown once again in FIG. 7. Here, the pressure punch DS is usually introduced as a tubular connection between an upper screw-on plate AP1 and a lower screw-on plate AP2, into an opening provided there, and is permanently connected with the screw-on plates AP1 and AP2 by means of a weld seam SW. The upper screw-on plate AP1 in turn has corresponding openings, by way of which the screws SC can engage into the punch plate ST. The screw connection of the pressure plates DP takes place analogous to the manner provided within the scope of the invention, by way of attachment elements BE, as shown in FIG. 8.

As long as the hole pattern of the upper screw-on plate AP1 through which the screw SC is passed agrees with the position of the bolts BO according to the invention, an already existing molding machine can also be retrofitted with the solution according to the invention.

The characteristics that are indicated above and in the claims, as well as that are evident in the figures, can advantageously be implemented both individually and in various combinations. The invention is not restricted to the exemplary embodiments described, but rather can be modified in many different ways, within the scope of the ability of a person skilled in the art.

Thus, although only some exemplary embodiments of the present invention have been shown and described, it is to be understood that many changes and modifications may be made thereunto without departing from the spirit and scope of the invention.

What is claimed is:

1. An apparatus for producing concrete molded parts in a molding machine, the apparatus comprising:

(a) a mold insert having an opening;

(b) an intermediate plate;

(c) an upper mold part having at least one pressure punch and a pressure plate arrangement comprising a plurality of pressure plates, each pressure plate facing the opening of the mold insert and screwed onto the intermediate plate, the at least one pressure punch comprising at least one threaded bolt and a hollow body enclosing the at least one threaded bolt; and (d) a punch plate disposed on the upper mold part;

wherein the intermediate plate is connected with the punch plate on a side of the intermediate plate facing the upper mold part by way of the at least one pressure punch;

wherein the intermediate plate is braced against the punch plate in that the at least one threaded bolt is passed through an accommodation on the intermediate plate;

wherein the at least one threaded bolt releasably engages into the punch plate; and wherein the hollow body encloses the at least one threaded bolt between the intermediate plate and the punch plate.

2. The apparatus according to claim 1, wherein the accommodation is formed as a depression having a step-shaped cross-section along a direction perpendicular to a surface of the intermediate plate.

3. The apparatus according to claim 2, wherein the step-shaped cross-section is on a side of the intermediate plate facing the punch plate and has a first inside dimension that corresponds to an outside dimension of the bolt.

4. The apparatus according to claim 3, wherein the step-shaped cross-section has a second inside dimension on a side of the intermediate plate that faces the pressure plate, said second inside dimension being selected to be greater than the first inside dimension.

5. The apparatus according to claim 4, wherein a screw head affixed to the bolt is introducible in a region of the second inside dimension in the intermediate plate, said screw head being disposed on the side that faces the pressure plate, below the surface of the intermediate plate.

6. The apparatus according to claim 4, further comprising a nut that engages into an outside thread of the bolt and introduced in a region of the second inside dimension in the intermediate plate, said nut being disposed on the side that faces the pressure plate, below the surface of the intermediate plate.

7. The apparatus according to claim 1, wherein the hollow body is configured as a hollow cylinder having an upper edge and a lower edge aligned plane-parallel to one another in an axial direction.

8. The apparatus according to claim 1, wherein the at least one threaded bolt is configured with a circular cross-section.

9. The apparatus according to claim 8, wherein the at least one threaded bolt is provided with an outside thread in a region of an end of the at least one threaded bolt that faces the punch plate.

10. The apparatus according to claim 1, further comprising a plurality of intermediate plates and a plurality of bolts and hollow bodies provided for each intermediate plate.

11. The apparatus according to claim 1, wherein the intermediate plate comprises openings for receipt of attachment elements in order to make a screw connection with the pressure plate.

12. The apparatus according to claim 1, wherein the intermediate plate is configured in one piece.

13. The apparatus according to claim 1, wherein the intermediate plate has a plurality of accommodations and openings and an outside circumference forming a closed curve, together with inner surfaces of the accommodations and the openings.

14. The apparatus according to claim 13, wherein the accommodations and the openings in the intermediate plate are offset inwardly from an outer edge of the intermediate plate, wherein the accommodations and the openings have recesses that face toward the outer edge.

* * * * *